US006217027B1

(12) United States Patent
Amrein et al.

(10) Patent No.: US 6,217,027 B1
(45) Date of Patent: Apr. 17, 2001

(54) COMPUTERIZED PORTABLE PNEUMATIC TARGET APPARATUS

(75) Inventors: Bruce E. Amrein, Bel Air; Thomas C. Fry, Havre De Grace; Richard N. Ware, Port Deposit; Douglas J. Struve, Bel Air, all of MD (US)

(73) Assignee: United States of America, Washington, DC (US)

( * ) Notice: Subject to any disclaimer, the term of this patent is extended or adjusted under 35 U.S.C. 154(b) by 0 days.

(21) Appl. No.: 09/257,140

(22) Filed: Feb. 22, 1999

Related U.S. Application Data

(60) Provisional application No. 60/076,832, filed on Mar. 2, 1998.

(51) Int. Cl.[7] ..... F41J 5/02; F41J 5/04; F41J 5/08; F41J 5/12

(52) U.S. Cl. ..... 273/371; 273/148 B; 273/148 R; 273/348; 273/355; 273/359; 463/49; 463/51; 463/53; 463/56; 463/57; 463/42

(58) Field of Search ..... 273/371, 348, 273/355, 357, 358, 359, 362, 366, 373, 376, 378, 386, 405, 406, 407, 408, 148 B, 148 R; 463/49, 51, 52, 53, 54, 56, 57, 42

(56) References Cited

U.S. PATENT DOCUMENTS

| | | | | |
|---|---|---|---|---|
| 3,580,579 | | 5/1971 | Scharz et al. | 372/102.2 A |
| 3,914,879 | * | 10/1975 | Taylor, III et al. | 434/19 |
| 3,943,855 | * | 3/1976 | Woodward | 102/70 R |
| 3,996,590 | * | 12/1976 | Hammack | 342/465 |
| 4,163,557 | * | 8/1979 | McLellan | 463/52 |
| 4,205,846 | * | 6/1980 | Levine | 463/52 |
| 4,244,583 | * | 1/1981 | Wood et al. | 273/373 |
| 4,266,776 | * | 5/1981 | Goldfarb | 364/410 |
| 4,763,903 | * | 8/1988 | Goodwin et al. | 273/371 |
| 4,799,688 | * | 1/1989 | Kellman et al. | 273/371 |
| 4,828,269 | * | 5/1989 | Tessel | 273/373 |
| 4,934,937 | * | 6/1990 | Judd | 434/21 |
| 5,163,689 | * | 11/1992 | Bateman | 273/406 |
| 5,350,180 | * | 9/1994 | Acock | 273/406 |
| 5,516,113 | * | 5/1996 | Hodge | 273/371 |
| 5,613,913 | * | 3/1997 | Ikematsu et al. | 463/52 |
| 5,672,109 | * | 9/1997 | Natanian | 463/52 |
| 5,695,196 | * | 12/1997 | Yanosky | 273/406 |
| 5,702,323 | * | 12/1997 | Poulton | 482/8 |
| 5,738,584 | * | 4/1998 | Ikematsu et al. | 463/52 |
| 5,775,998 | * | 7/1998 | Ikematsu et al. | 463/52 |
| 5,785,592 | * | 7/1998 | Jacobsen | 463/7 |
| 5,823,779 | * | 10/1998 | Muehle et al. | 434/21 |

* cited by examiner

*Primary Examiner*—Jessica J. Harrison
*Assistant Examiner*—Binh-An D. Nguyen
(74) *Attorney, Agent, or Firm*—Paul S. Clohan

(57) ABSTRACT

A computerized portable pneumatic target apparatus includes at least one target; a computer located at the firing point of a shooting range and connected by a first wireless radio frequency link to the at least one target for controlling operation of the at least one target; a shot detector located at the firing point and connected by either a second wireless radio frequency link or a wire to the computer; an air operated mechanism for raising and lowering the at least one target; a source of air pressure located near the at least one target and connected to the air operated mechanism; and a source of direct current located near the at least one target and connected to the air operated mechanism and the first wireless radio frequency link.

26 Claims, 5 Drawing Sheets

COMPUTERIZED PORTABLE PNEUMATIC TARGET APPARATUS

RELATED APPLICATIONS

This application claims the benefit of U.S. Provisional Application No. 60/076,832 filed Mar. 2, 1998.

GOVERNMENT USE

The invention described herein may be manufactured, used and licensed by or for the U.S. Government for governmental purposes without payment of any royalty.

BACKGROUND OF THE INVENTION

The Human Research and Engineering Directorate of the Army Research Laboratory developed and currently operates a computer controlled small-arms firing facility known as the M-Range Shooter Performance Facility. This range is a permanent facility consisting of 160 targets arranged into four lanes of 40 targets each, at distances from 10 meters to 550 meters. The facility is capable of providing single and multiple target presentations of any duration and combination with real-time data collection to include time of shot, time of hit, target range, target presentation time, time between target presentations, and total shots and hits.

The need exists to collect M-Range type data at distances greater than 550 meters and to be able to deploy an apparatus for collecting M-Range type data to any approved small-arms firing range. The present invention, the Computerized Portable Pneumatic Target Apparatus, was developed to address this need. The result is a self-contained small arms computerized firing facility capable of being deployed on any approved firing range. The facility is capable of controlling in excess of twenty four pop-up E-type (or similar) silhouettes at distances up to 2000 meters and collecting M-Range type data. The system supports semi-automatic and fully-automatic weapons as well as single and multiple target presentations.

Prior art in the area of pop-up target range apparatus differs from the present invention in two distinct areas. First, pop-up target mechanisms existing today are electrically operated using either battery power or AC power provided via underground cables. Underground cables are not feasible for ranges beyond 600 meters because of the necessity for using step-up and step-down transformers and large-gauge wire to overcome the voltage-drop associated with long cable runs. Additionally, electrically operated mechanisms, especially DC powered systems, typically generate sufficient electromagnetic interference, which interfere with collection of hit data from electrical scoring silhouettes. These systems are not suitable for portable operation.

Secondly, prior art pop-up target systems use impact switches or accelerometers to detect the impact of a projectile on a rigid silhouette. Using impact to detect hits allows projectiles directly hitting the target to be scored as hits. Likewise rocks, gravel, and other debris kicked up by bullets impacting in the vicinity of the target causes hits to be scored. Because of the nature of the impact detection device on prior art mechanisms, the entire silhouette is considered to be one hit zone. This makes it difficult to segment the silhouette into numerous hit zones. (i.e. center of mass, head, grazing hits.)

SUMMARY OF THE INVENTION

It is an object of the present invention to provide a self-contained small arms computerized firing facility capable of being deployed on any approved firing range.

Further objects, features and advantages of the present invention will become apparent from the following detailed description taken in conjunction with the accompanying drawing.

DETAILED DESCRIPTION OF THE PREFERRED EMBODIMENTS

The present invention is air operated, using a DC powered electrical solenoid coil to open and close an air valve thereby providing compressed air to an air cylinder causing a target, for example, a silhouette of a human, to be presented to or removed from view of the shooter. By using solid-state devices to control the power to the air valve, it is possible to actuate the air valve while minimizing electromagnetic interference. Using air as the primary source of power to raise and lower the target reduces the power required at each target location. This permits the use of smaller gauge wire and eliminates the need for transformers when operating with AC power, and also makes it feasible to operate with low ampacity batteries (either primary or rechargeable).

Use of an electrical hit detection silhouette has many benefits. The silhouette only detects metallic projectiles as they pass through the silhouette. This eliminates false hits due to rocks and gravel impacting the silhouette as a result of projectiles impacting near the target. An electrical hit detection system also has the benefit of permitting the silhouette to be divided into a multiplicity of hit zones. Unfortunately, non-metallic projectiles will not score as hits with an electrical hit detection system.

Typically, it is desirable to divide the silhouette into three or more segments—center of mass, head, and a zone designated for grazing hits. Additionally, for law enforcement purposes it is desirable to indicate an "8-ring" and a "9-ring" to measure the accuracy with which law enforcement officers hit their target. This is easily accomplished with an electrically scoring silhouette.

Unlike silhouettes that detect hits with an impact switch, the status of each zone of the electrically scoring silhouette is periodically monitored electronically to verify that it is capable of detecting projectiles as they pass through the silhouette.

Figure 1:
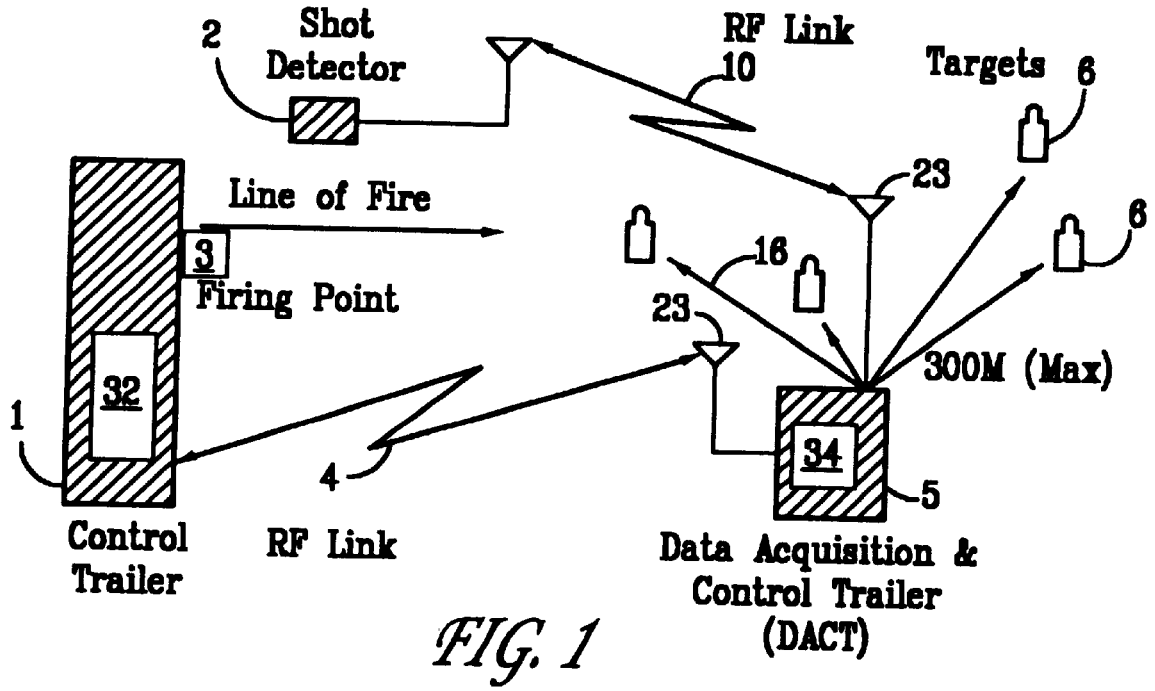
FIG. 1 schematically shows a wired embodiment of the present invention.

FIG. 1 schematically shows a wired system configuration of the invention. A mobile trailer 1, located at the firing point 3, contains a personal computer 32, which controls the operation of the portable targets 6. Portable range software residing on this system is detailed later in this section. A wireless network 4 accomplishes communication between the computer 32 at the firing point 3 and the data acquisition/control trailer (DACT) 5. Shot detection, implemented by a pressure transducer 2, is communicated from the firing point 3 to the DACT 5 by a radio frequency (RF) link 10.

Figure 2:
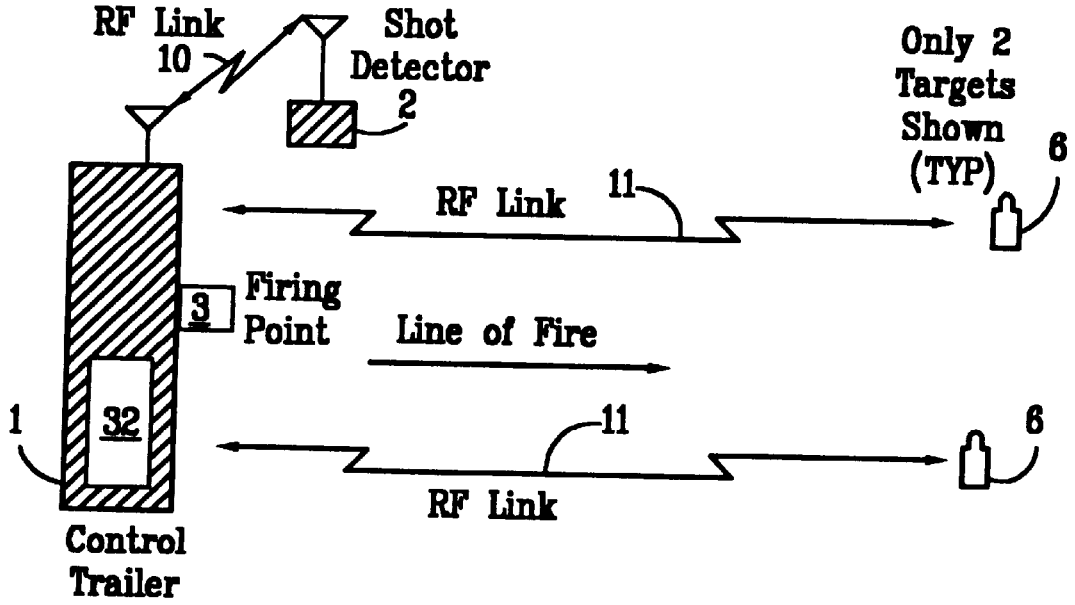
FIG. 2 schematically shows a wireless embodiment of the present invention.

In the wireless configuration depicted in FIG. 2, the DACT 5 is eliminated and target control and data acquisition are communicated with a computer 32 in the control trailer by an RF link 11. The shot detection information is communicated to a computer 32 in the control trailer by an RF link 10.

As schematically shown in FIG. 1, control cables 16 connect each target 6 to a data acquisition and control trailer 5 (DACT) typically located several hundred meters downrange from the firing point 3. The DACT (FIG. 1) is a mobile climate controlled data acquisition trailer 5 containing a Pentium-class personal computer 34 with commercially available data acquisition modules and associated signal conditioning circuitry. An internal combustion engine powered electric generator powers the trailer. In the configuration with a central air supply connected to each target mechanism by air hose 17 (FIG. 3), an internal combustion engine powers an air compressor. Two antennas 23 are mounted on the exterior of the trailer 5, one for receiving the signal from the shot detector 2 at the firing point, and the other for full-duplex local area network (LAN) 4 communications with another personal computer 32 located at the firing point 3. The computer 32 is used to generate target scenarios and provide for firing data reporting at the firing point. The wireless LAN 4 allows the data acquisition trailer 5 to be located at distances greater than 1000 meters from the firing point. Each target 6 is interfaced to the trailer 5 by a 1000 (nominal) foot control cable 16. This permits a 600-meter total coverage area (i.e. ±300 meters from the trailer).

Figure 3:
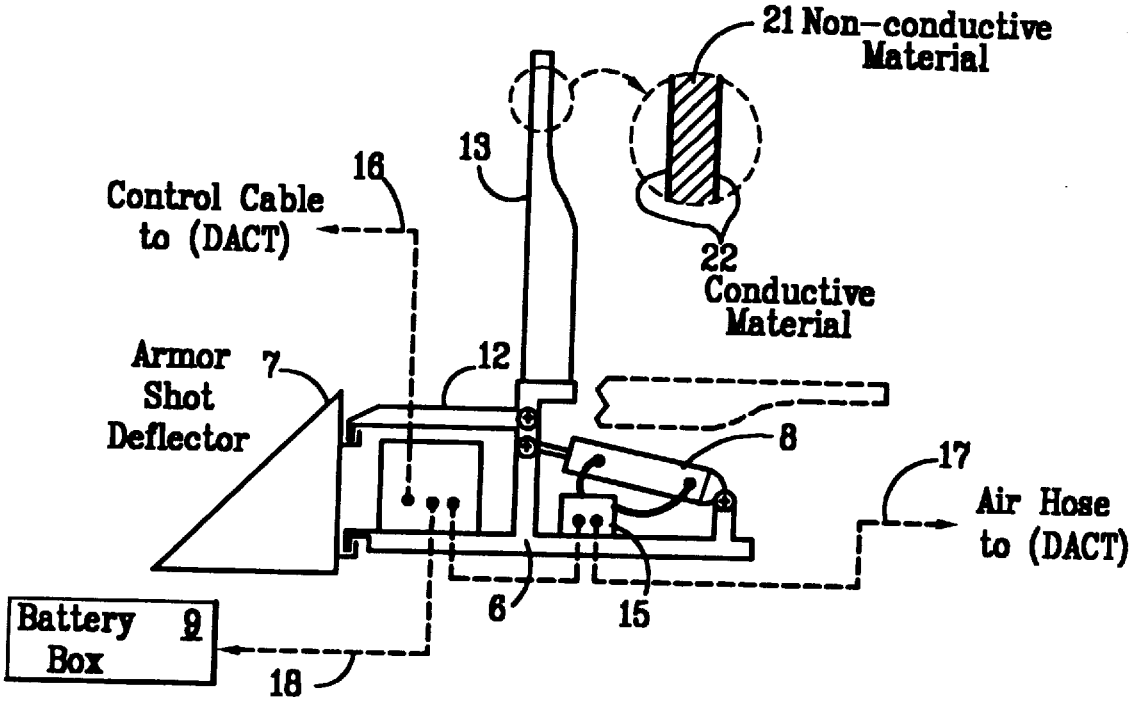
FIG. 3 is a side view of a pneumatic target mechanism hardwired to a data acquisition and control trailer (DACT).
Figure 4:
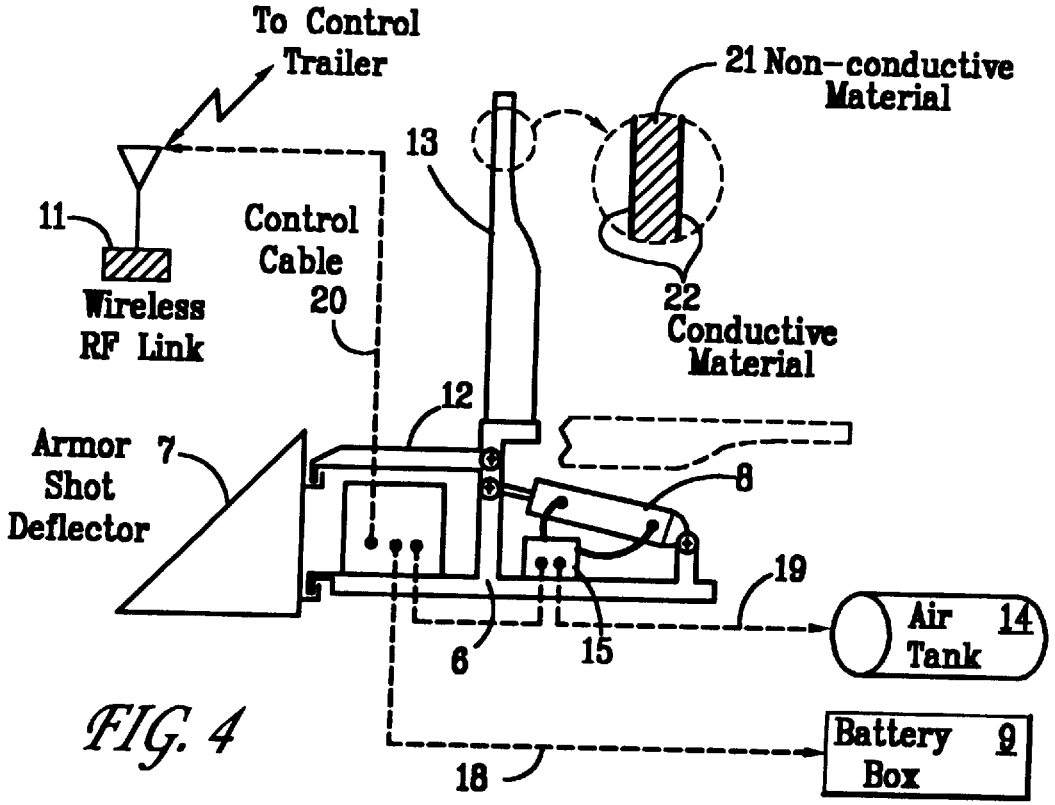
FIG. 4 is a side view of a pneumatic target mechanism with an airtank and wireless link.

As shown in FIGS. 3 and 4, a target 6 comprises an E-type silhouette 13 mounted on a pneumatic target mechanism 12. The mechanisms are capable of raising and lowering the silhouette under computer control and returning positional as well as silhouette condition information to the data acquisition trailer. A target silhouette 13 comprises two conductive plates 22 separated by a non-conductive material 21. When a metallic projectile passes through the silhouette 13, the projectile momentarily contacts both conductive plates 22 causing a short electronic signal to be sent back to the DACT 5. This signal is validated through software with the shot detection information and is time tagged.

Figure 6:
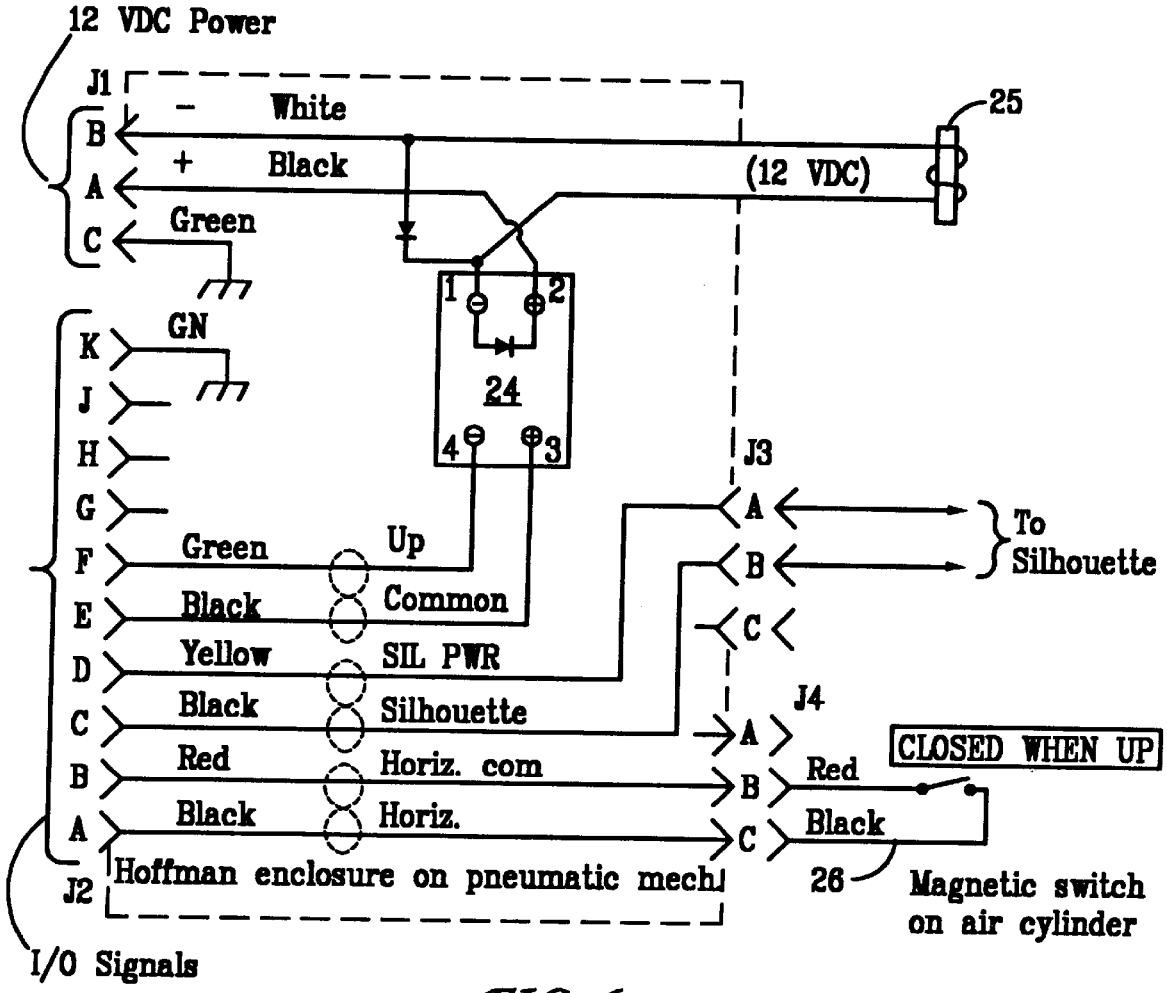
FIG. 6 is a schematic wiring diagram of a typical pop-up target apparatus.

The target mechanisms 12 may be attached to armored bullet deflectors 7 to protect the mechanisms 12 from stray shots and to maintain alignment on rough terrain. The target mechanisms 12 are capable of raising and lowering the silhouette13 under computer control via a DC solid-state relay 24 and 12-volt coil 25 (FIG. 6) in an air valve 15 which is powered by a 12-volt DC battery box 9 located in the vicinity of each target. The battery box 9 is connected to the target mechanism by a wire 18. Each target mechanism 12 contains a pneumatic air cylinder 8, which is pressurized from an air compressor located at the DACT 5 by standard air hose 17. A magnetic switch 26 (FIG. 6) located on the pneumatic air cylinder 8 provides target positional information. Silhouette condition information is available from each mechanism by monitoring the DC voltage present at the silhouette.

Figure 5:
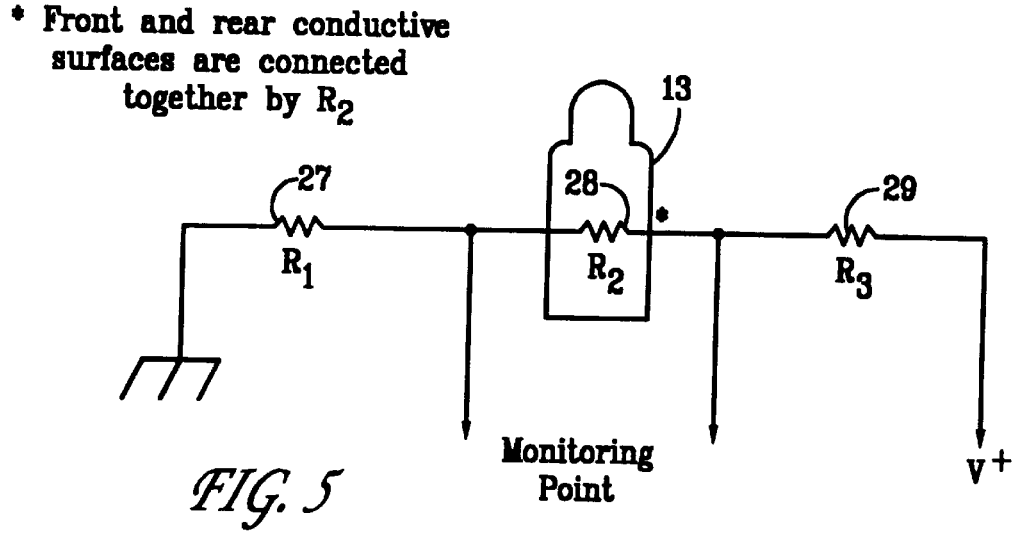
FIG. 5 schematically shows an electrically scoring silhouette.
Figure 7:
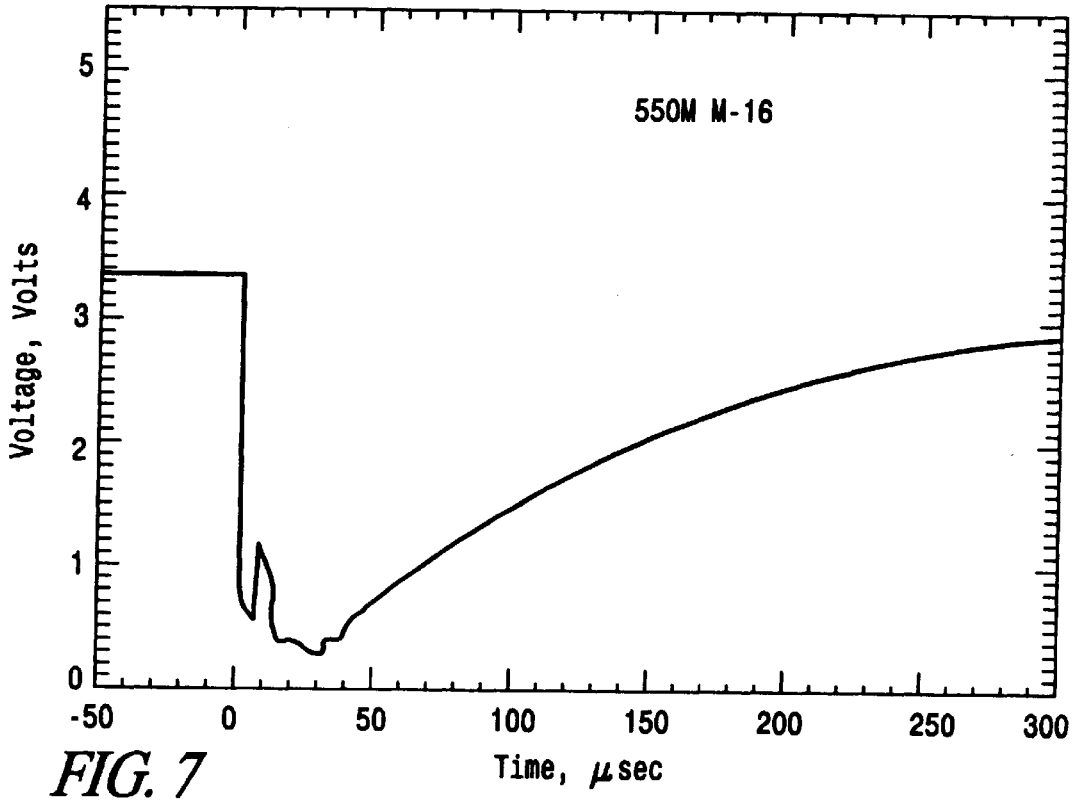
FIG. 7 graphically shows a typical electrical pulse as a 5.56 mm projectile strikes an electrically scoring silhouette.
Figure 8:
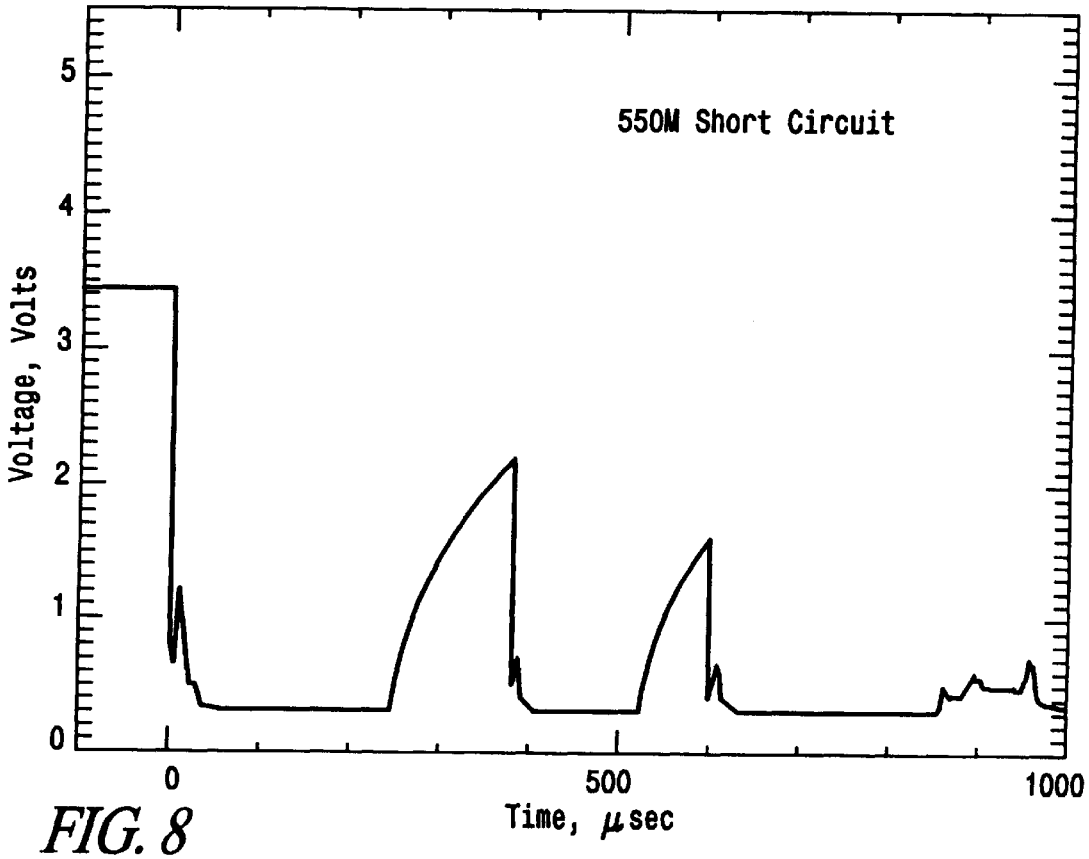
FIG. 8 graphically shows a typical short circuit between front and rear surfaces of an electrically scoring silouette.
Figure 9:
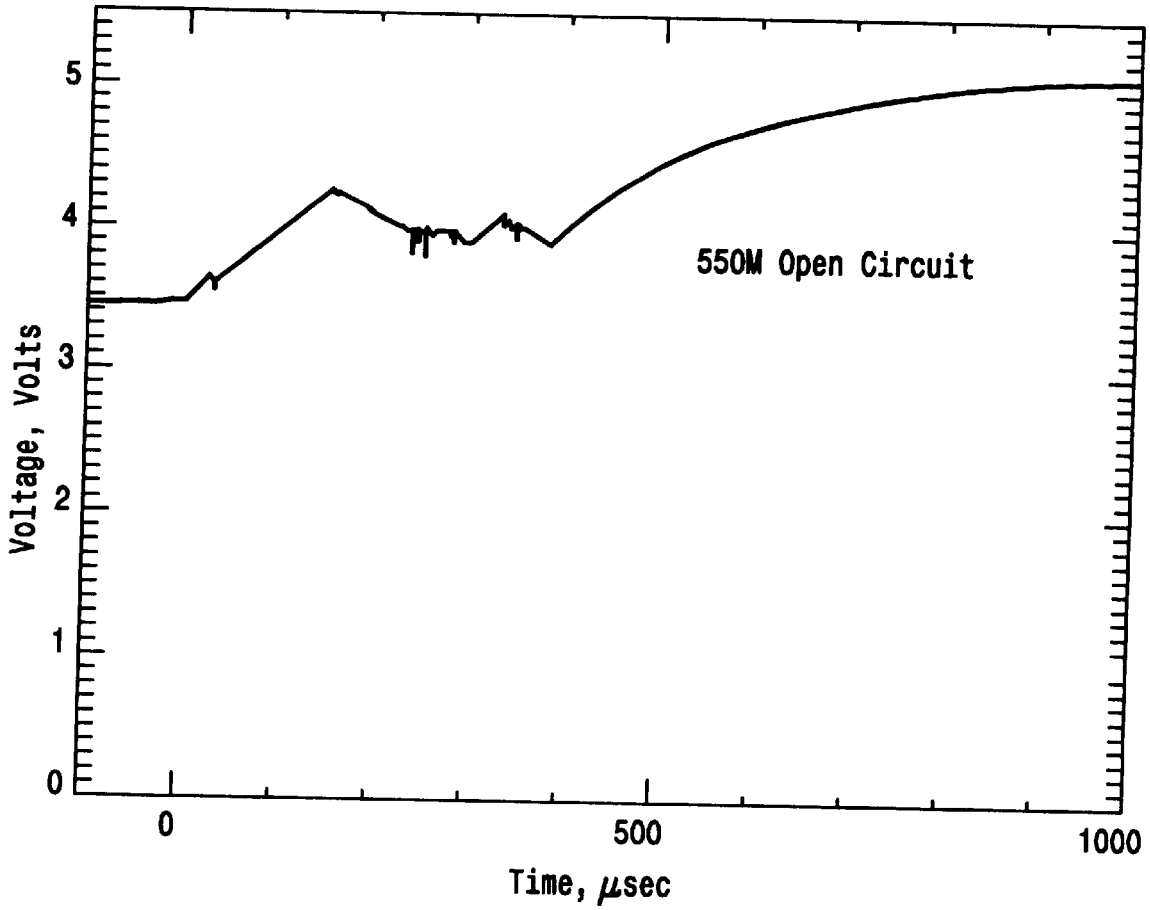
FIG. 9 graphically shows a typical open circuit of an electrically scoring silhouette (resistor or wires failed).

Details of the voltage presented by the silhouette under various conditions are shown in FIGS. 7, 8, and 9. FIG. 5 schematically shows a typical electrically scoring silhouette, where a voltage divider circuit is established consisting of three resistors $R_1$ 27, $R_2$ 28, and $R_3$ 29. Typical values of the resistors, for example, are: $R_1$ is 150 ohms, $R_2$ is 8200 ohms, and $R_3$ is 3700 ohms. When excited by a DC voltage of typically approximately 5 volts, the voltage divider causes a voltage of approximately 3.5 volts DC to be applied to the conductive surfaces 22 of the silhouette 13. This voltage is periodically monitored to verify the state of the silhouette. The front and rear surfaces of the silhoutte 13 are connected together by resistor 28 (R2).

In FIG. 7 the voltage is shown being reduced to less than one-volt DC as a metallic projectile passes through the silhouette. The projectile effectively creates a momentary short-circuit across $R_2$ 28. This causes the voltage monitored across $R_2$ to approach zero volts. This is scored as a hit. If the voltage across $R_2$ remains at a low voltage level for a period of time, it is interpreted as a short-circuit. As shown in FIG. 8, a shorted silhouette 13 is incapable of scoring hits. Likewise, if the resistor R2 or the wires connecting it to silhouette 13 are broken the voltage recorded approaches the supply voltage. This is considered to be an open circuit (FIG. 9), which, likewise is incapable of detecting hits.

A preferred embodiment which eliminates the DACT 5 is shown in FIGS. 2 and 4. In this configuration, the air pressure required to raise and lower a target is provided by a 10-gallon portable air tank 14 located near the target mechanism 12 and connected thereto by air hose 19. A 12-volt battery enclosed in a weather-tight container 9, which is also located near the target mechanism 12 and connected thereto by wire 18, provides the required DC power. Target control and status information is communicated directly to the control trailer 1 by an RF link 11 from each target to a personal computer 32 located at the control trailer. The RF link 11 is connected to the target mechanism 12 by a control cable 20.

Software development was accomplished with commercially available data acquisition software tools based on the C programming language. Several software modules have been developed to operate this system either directly from the mobile data acquisition trailer or over a wireless network. A scenario creation module is available to generate target scenario files which contain a sequence of user specified target events. Targets can either go down on the first hit or remain standing for the entire presentation time. Also, for multiple target events, targets can be grouped so that they are treated as a single target. For example, if any one target in the group is hit, all targets will go down.

The main software module uses a scenario file to conduct a scenario complete with data acquisition and reporting. This module is capable of running a complete scenario with or without data collection, verifying target integrity, and reporting firing data from the currently running scenario or a previously executed scenario. Data can be stored in a file, printed immediately, or imported to a popular spreadsheet program such as Excel.

The operation of the portable target system can be exemplified by looking at one lane, one target, and one firing position. The range control computer located at the firing point initiates a firing event by sending to the desired target the required command to raise the target. This is accomplished by sending a signal to a solid state relay causing it to allow air pressure to operate the target's air cylinder. With air applied to the air cylinder 8 the target silhouette 13 is presented to the shooter. As the target comes up, a magnetic switch 26 on the air cylinder changes state. This switch is monitored by the range control computer for accurate target exposure timing and to indicate at what time the target actually becomes visible to the shooter. Once the target is determined to be visible, the shooter can then acquire the target and commence firing. The shot detector 2 responds to each shot fired by sending a signal to the range control computer which time tags the shot and stores it.

If a bullet passes through the target silhouette 13, an electronic pulse is generated which is communicated back to the range control computer. The hit is time tagged and validated against all shots which have occurred in the lane since the target was presented. The hit is validated against a ballistic table for the munitions being used. This is done for error checking purposes and to determine the actual shot that caused the hit. The target can then be lowered thus ending the event or can be left standing for a pre-determined exposure time to count multiple hits. In either case, the target is lowered by a command from the range control computer when the exposure time has elapsed.

While the invention has been disclosed with reference to certain preferred embodiments, numerous changes, alterations and modifications to the disclosed embodiments are possible without departing from the spirit and scope of the invention, as described in the appended claims and equivalents thereof.

What is claimed is:

1. A computerized portable pneumatic target apparatus, comprising:

at least one target;

a computer located at a firing point of a shooting range and connected by a first wireless bi-directional radio frequency link to said at least one target for controlling operation of said at least one target so as to display or hide said at least one target and to provide feedback to a range controller that said at least one target did in fact move and to record and time-tag every hit on said at least one target;

a shot detector used to determine when a weapon has been fired for the purpose of time-tagging this event located at the firing point and connected by one of a second wireless bi-directional radio frequency link and a wire to said computer;

an air operated mechanism for raising and lowering said at least one target;

a source of air pressure located near said at least one target and connected to said air operated mechanism; and a source of direct current located near said at least one target and connected to said air operated mechanism and said first wireless radio frequency link.

2. The apparatus of claim 1 wherein said source of air pressure is a portable air tank.

3. The apparatus of claim 1 wherein said source of direct current is a battery.

4. The apparatus of claim 1 wherein said at least one target is an electrically scoring silhouette.

5. The apparatus of claim 4 wherein said electrically scoring silhouette comprises two conductive plates separated by a non-conductive material.

6. The apparatus of claim 1 wherein said air operated mechanism comprises an air cylinder, an air valve connected to said air cylinder and said source of air pressure, an electrical coil for opening and closing said air valve and a solid state relay for switching said electrical coil.

7. The apparatus of claim 6 further comprising a magnetic switch on said air cylinder for providing positional information of said at least one target.

8. The apparatus of claim 5 wherein said electrically scoring silhouette comprises a voltage divider circuit comprising three resistors.

9. The apparatus of claim 1 further comprising an enclosure suitable for use by humans wherein said computer is located in said enclosure.

10. The apparatus of claim 1 further comprising a plurality of targets each connected by wireless radio frequency links to said computer.

11. The apparatus of claim 4 wherein the electrically scoring silhouette comprises one hit detecting zone.

12. The apparatus of claim 4 wherein the electrically scoring silhouette comprises a plurality of hit detecting zones.

13. The apparatus of claim 1 further comprising an armored bullet deflector wherein the at least one target is mounted on the armored bullet deflector.

14. A computerized portable pneumatic target apparatus, comprising:

at least one target;

a first computer located at a firing point of a shooting range;

a second computer located downrange of the first computer and connected to the first computer by a first wireless bi-directional radio frequency link so as to display or hide said at least one target and to provide feedback to a range controller that said at least one target did in fact move and to record and time-tag every hit on said at least one target;

a shot detector used to determine when a weapon has been fired for the purpose of time-tagging this event located at the firing point and connected by a second wireless bi-directional radio frequency link to said second computer;

an air operated mechanism for raising and lowering said at least one target;

a control cable connecting said at least one target and said second computer;

a source of air pressure located near said second computer and connected to said air operated mechanism; and a source of direct current located near said second computer and connected to said air operated mechanism.

15. The apparatus of claim 14 wherein said source of air pressure is an air compressor connected by hose to said air operated mechanism.

16. The apparatus of claim 14 wherein said source of direct current is a battery.

17. The apparatus of claim 14 wherein said at least one target is an electrically scoring silhouette.

18. The apparatus of claim 17 wherein said electrically scoring silhouette comprises two conductive plates separated by a non-conductive material.

19. The apparatus of claim 14 wherein said air operated mechanism comprises an air cylinder, an air valve connected to said air cylinder and said source of air pressure, an electrical coil for opening and closing said air valve and a solid state relay for switching said electrical coil.

20. The apparatus of claim 19 further comprising a magnetic switch on said air cylinder for providing positional information of said at least one target.

21. The apparatus of claim 18 wherein said electrically scoring silhouette comprises a voltage divider circuit comprising three resistors.

22. The apparatus of claim 14 further comprising an enclosure suitable for use by humans wherein said second computer is located in said enclosure.

23. The apparatus of claim 14 further comprising a plurality of targets connected by control cables to said second computer.

24. The apparatus of claim 17 wherein the electrically scoring silhouette comprises one hit detecting zone.

25. The apparatus of claim 17 wherein the electrically scoring silhouette comprises a plurality of hit detecting zones.

26. The apparatus of claim 14 further comprising an armored bullet deflector wherein the at least one target is mounted on the armored bullet deflector.

* * * * *